US005516439A

United States Patent [19]

Takeuchi et al.

[11] Patent Number: 5,516,439

[45] Date of Patent: May 14, 1996

[54] GREASE COMPOSITION FOR CONSTANT VELOCITY JOINTS

[75] Inventors: Kiyoshi Takeuchi; Tuyoshi Sasaki, both of Tokyo, Japan

[73] Assignee: Kyodo Yushi Co., Ltd., Tokyo, Japan

[21] Appl. No.: 279,104

[22] Filed: Jul. 22, 1994

[51] Int. Cl.[6] ..... C10M 141/02; C10M 141/08

[52] U.S. Cl. ..... 252/18; 252/32.7 E; 252/33.6; 252/40.5; 252/42

[58] Field of Search ..... 252/18, 25, 32.7 E, 252/33.6, 46.6, 51.5 A, 49.7, 40.5, 42

[56] References Cited

U.S. PATENT DOCUMENTS

| | | | |
|---|---|---|---|
| 3,223,624 | 12/1965 | Morway | 252/25 |
| 3,396,108 | 8/1968 | Caruso | 252/25 |
| 3,840,463 | 10/1974 | Froeschmann et al. . | |
| 3,939,082 | 2/1976 | Williams et al. . | |
| 4,444,669 | 4/1984 | Wittse, Jr. et al. | 252/25 |
| 4,529,526 | 7/1985 | Inoue et al. | 252/32.7 E |
| 4,536,308 | 8/1985 | Pehler et al. | 252/49.9 |
| 4,551,258 | 11/1985 | Ikeda et al. | 252/32.7 E |
| 4,759,859 | 7/1988 | Waynick . | |
| 4,787,992 | 11/1988 | Waynick . | |
| 4,830,767 | 5/1989 | Waynick . | |
| 4,840,740 | 6/1989 | Sato et al. . | |
| 4,902,435 | 2/1990 | Waynick . | |
| 5,001,013 | 3/1991 | Sturwold et al. | 252/49.5 |
| 5,126,062 | 6/1992 | Barnes | 252/18 |
| 5,160,645 | 11/1992 | Okaniwa et al. . | |
| 5,207,936 | 5/1993 | Anzai et al. | 252/25 |

FOREIGN PATENT DOCUMENTS

| | | |
|---|---|---|
| 0508115 | 10/1992 | European Pat. Off. . |
| 59-122597 | 7/1984 | Japan . |
| 62-207397 | 9/1987 | Japan . |
| 4-304300 | 10/1992 | Japan . |
| 2185492 | 7/1987 | United Kingdom . |
| WO94/11470 | 5/1994 | WIPO . |

OTHER PUBLICATIONS

Database WPI, Derwent Publications, AN-93-374803, JP-A-5 279686, Oct. 26, 1993.

Database WPI, Derwent Publications, AN-82-03597J, JP-A-57 172996, Oct. 25, 1982.

Database WPI, Derwent Publications, AN-94-253125, JP-A-6 184583, Jul. 5, 1994.

*Primary Examiner*—Margaret Medley

*Attorney, Agent, or Firm*—Oblon, Spivak, McClelland, Maier & Neustadt

[57] ABSTRACT

A grease composition for constant velocity joints comprises (a) a base oil; (b) a lithium-containing thickener selected from the group consisting of lithium soap and lithium complex soap; (c) an organic molybdenum compound selected from the group consisting of molybdenum dithiophosphates and molybdenum dithiocarbamates; (d) a zinc dithiophosphate; and optionally (e) a metal salt selected from the group consisting of metal salts of oxidized waxes, metal salts of petroleum sulfonates and metal salts of alkyl aromatic sulfonates. The grease composition for constant velocity joints exhibits a substantially improved effect of reducing friction coefficient and a substantially improved effect of preventing the occurrence of vibration.

8 Claims, No Drawings

GREASE COMPOSITION FOR CONSTANT VELOCITY JOINTS

BACKGROUND OF THE INVENTION

The present invention relates to a grease composition for constant velocity joints used in motorcars, in particular, for plunging type constant velocity joints. A very high surface pressure is applied to the constant velocity joint to be lubricated and abnormal vibrations may often be caused due to complicated rolling and sliding motions of the joint. Accordingly, the present invention, more specifically, relates to a grease composition for constant velocity joints which can effectively lubricate such constant velocity joints to thus efficiently reduce frictional force and to efficiently inhibit the occurrence of any vibration thereof.

Examples of lubricating greases conventionally used in such constant velocity joints include a grease comprising a calcium complex soap as a thickening agent; and a grease comprising a lithium soap, as a thickening agent, and a sulfur-phosphorus atom containing extreme pressure agent selected from the group consisting of, for instance, sulfurized fats and oils and, tricresyl phosphate and zinc dialkyldithiophosphate.

In the recent motorcar industries, the number of FF-type motorcars have rapidly increased from the viewpoint of making the weight thereof lighter and of securing the dwelling space and the constant velocity joints (CVJ) indispensable to the achievement of such purpose have widely been used therein. Among the CVJ's, the plunging type constant velocity joints, in particular, tripod type constant velocity joints (TJ), double offset type constant velocity joints (DOJ) and the like cause complicated rolling and sliding motions at a certain angle and hence generate slide resistance in the axial direction during the rotational motion thereof and this becomes a cause of vibrations during idling, rolling of a car body during starting and speeding up thereof and emission of beating sounds and/or sounds filled within the car observed at a specific velocity. Various methods for improving the structures of the constant velocity joints (CVJ) per se have been proposed in order to solve this problem, but the improvement thereof is difficult from the viewpoint of the space occupied by the joint, and the weight and cost thereof.

SUMMARY OF THE INVENTION

Accordingly, an object of the present invention is to provide a grease composition for reducing the vibrational motions of the constant velocity joints.

Another object of the present invention is to provide a grease composition for plunging type constant velocity joints which can effectively lubricate the constant velocity joints of this type to thus efficiently reduce frictional force and to efficiently inhibit the occurrence of any vibration.

The inventors of this invention have conducted various studies to develop a grease composition capable of reducing frictional force acting on a constant velocity joint and inhibiting any vibration thereof and carried out a quality evaluation of greases used under conditions which are liable to cause vibration, using an SRV (Schwingungs Reibung und Verschleiss) tester known as the vibration friction/wear tester. As a result, the inventors have found out that there is a specific correlation between the vibration generated by the constant velocity joints as a vibration-generating source and the the friction coefficient observed under specific vibration conditions as determined by the SRV tester. Moreover, the inventors have investigated various combinations of lithium soap or lithium complex soap, as a base grease component, with various kinds of extreme pressure agents and oiliness improvers or the like, in the light of the foregoing relation, and found that the foregoing object of the present invention can be accomplished through the use of a specific combination of selected compounds and thus have completed the present invention.

According to an aspect of the present invention, there is provided a grease composition for constant velocity joints which comprises (a) a base oil; (b) a lithium-containing thickener selected from the group consisting of lithium soap and lithium complex soap; (c) an organic molybdenum compound selected from the group consisting of molybdenum dithiophosphates and molybdenum dithiocarbamates; and (d) a zinc dithiophosphate.

According to another aspect of the present invention, there is provided a grease composition for constant velocity joints which comprises (a) a base oil; (b) a lithium-containing thickener selected from the group consisting of lithium soap and lithium complex soap; (c) an organic molybdenum compound selected from the group consisting of molybdenum dithiophosphate and molybdenum dithiocarbamate; (d) a zinc dithiophosphate; and (e) a metal salt selected from the group consisting of metal salts of oxidized waxes, metal salts of petroleum sulfonates and metal salts of alkyl aromatic sulfonates.

DESCRIPTION OF THE PREFERRED EMBODIMENTS

The present invention will hereunder be described in more detail.

First of all, the base oil as the component (a) used in the grease composition for constant velocity joints of the present invention is not restricted to specific ones, but preferably selected from the group consisting of lubricating oils such as mineral oils, ester type synthetic oils, ether type synthetic oils and hydrocarbon type synthetic oils and mixtures thereof.

The lithium-containing thickener as the component (b) used in the grease composition is selected from the group consisting of lithium soaps such as lithium salts of 12-hydroxystearic acid and stearic acid and lithium complex soaps such as lithium soaps of, for instance, 12-hydroxystearic acid and dibasic acids such as azelaic acid. In this respect, if the lithium complex soap is used, the heat resistance of the resulting grease composition can further substantially be improved.

The organic molybdenum compound as the component (c) of the grease composition is selected from the group consisting of molybdenum dithiophosphates represented by the following general formula (I):

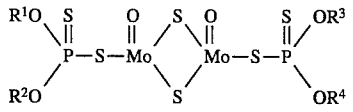

(I)

wherein $R^1$, $R^2$, $R^3$ and $R^4$ each independently represents a primary or secondary alkyl group having 1 to 24, preferably 3 to 20 carbon atoms or an aryl group having 6 to 30, preferably 8 to 18 carbon atoms and molybdenum dithiocarbamates represented by the following general formula (II):

$$[(R^5)(R^6)N—CS—S]_2—Mo_2OmSn \quad (II)$$

wherein $R^5$ and $R^6$ each independently represents an alkyl group having 1 to 24, preferably 3 to 18 carbon atoms; m ranges from 0 to 3 and n ranges from 4 to 1, provided that m+n=4.

The zinc dithiophosphate as the component (d) of the grease composition is an extreme pressure agent represented by the following general formula (III):

$$(R^7O)(R^8O)SP—S—Zn—S—PS(OR^9)(OR^{10}) \quad (III)$$

wherein $R^7$, $R^8$, $R^9$ and $R^{10}$ may be the same or different and each represents an alkyl group having 1 to 24, preferably 3 to 20 carbon atoms or an aryl group having 6 to 30, preferably 8 to 18 carbon atoms. The alkyl group may be a primary or secondary alkyl group. In particular, excellent effect can be expected if the substituents $R^7$, $R^8$, $R^9$ and $R^{10}$ represent a combination of primary and secondary alkyl groups each having 3 to 8 carbon atoms.

In the second aspect of the present invention, a metal salt is used as the component (e) in addition to the foregoing components (a) to (d) and the metal salt is selected from the group consisting of metal salts of oxidized waxes, metal salts of petroleum sulfonates prepared by sulfonating aromatic hydrocarbon components present in fractions of lubricating oils and metal salts of alkyl aromatic sulfonates such as dinonylnaphthalenesulfonic acid, alkylbenzenesulfonic acid and overbasic alkylbenzenesulfonic acids. Examples of the metal salts include sodium salts, potassium salts, calcium salts, magnesium salts, zinc salts, barium salts, aluminum salts and lead salts with the calcium salts being most preferred. These compound are all widely known as rust inhibitors. Particularly preferred are calcium salts of oxidized waxes which ensure quite excellent effect.

The grease composition according to the first aspect of the present invention is characterized in that (a) a base oil, (b) a lithium-containing thickener, (c) an organic molybdenum compound and (d) a zinc dithiophosphate are combined in a specific compounding ratio to thus give a lithium-containing grease, i.e., the grease composition of the present invention. On the other hand, the grease composition according to the second aspect of the present invention is characterized in that the forgoing components (a) to (d) and the component (e) are combined in a specific compounding ratio to thus give a lithium-containing grease, i.e., the grease composition of the present invention. These grease compositions show an effect substantially superior to that attained by a composition comprising the foregoing components (a) and (b) to which the component (c), (d) or (e) is separately added and can thus ensure the foregoing object of the present invention.

The reason why the foregoing effect can be accomplished by the foregoing grease composition would be as follows, although any positive evidence was not secured. It has been known that the organic molybdenum compound as the component (c) undergoes self-decomposition on the surface to be lubricated to thus form a film of a high molecular weight compound having viscoelasticity, which covers the metallic parts on the portions to be lubricated, or to form, through the self-decomposition, molybdenum disulfide which serves to reduce the frictional force acting on the parts or any wear thereof. Moreover, the molybdenum dithiocarbamate has a dithiocarbamic acid structure in the molecule like the zinc dithiocarbamates or the like which have conventionally been known as vulcanization accelerators for rubbers and therefore, it is believed that the molybdenum dithiocarbamate has a vulcanization-accelerating effect. In this respect, the term "vulcanization-accelerating effect" means an effect of activating sulfur atoms and rubber hydrocarbons and thus promoting the crosslinking reaction between hydrocarbon molecules through the activated sulfur atoms.

The sulfur atom and hydrocarbon group of the zinc dithiophosphate as the component (d) are activated due to the foregoing effect, the crosslinking reaction is thus caused between the molecules to form a high molecular weight compound. The compound in turn covers the lubricating film and forms a polymer film having viscoelasticity and the resulting viscoelastic film absorbs any vibration generated and prevents any wear of the metallic parts through inhibition of any contact between the metallic parts. Further the polymer film is easily sheared. Thus, the friction of the lubricated portions would be reduced.

The metal salt selected from the group consisting of metal salts of oxidized waxes, metal salts of petroleum sulfonates and metal salts of alkyl aromatic sulfonates used as the component (e) in the second aspect of the present invention is in general used as a rust inhibitor and shows a rust-inhibitory effect due to the protection of the metallic surface on the face to be lubricated through adhesion thereof to the metallic surface. In the present invention, however, it can be considered that the metal salt is uniformly distributed throughout the face to be lubricated and in particular, the calcium atom can make the friction-reducing effect of the film of the high molecular weight compound formed from the component (c) and (d) more effective through the wear-inhibitory effect of calcium atoms.

The grease composition for constant velocity joints of the present invention comprises, on the basis of the total weight of the composition, 75 to 94% by weight, preferably 79 to 91% by weight of the basic oil as the component (a): 2 to 15% by weight, preferably 5 to 10% by weight of the lithium-containing thickening agent as the component (b); 0.5 to 10% by weight, preferably 2 to 5% by weight of the organic molybdenum compound as the component (c); and 0.5 to 5% by weight, preferably 1 to 3% by weight of the zinc dithiophosphate as the component (d). The content of the metal salt as the component (e) in the grease composition according to the second aspect ranges from 0.5 to 5% by weight, preferably 1 to 3% by weight based on the total weight of the composition.

In this respect, if the content of the component (b) is less than 2% by weight, the component does not serve as a thickening agent and never provides a desired grease composition. On the other hand, if it exceeds 15% by weight, the resulting grease composition is too hard to ensure the intended effect. If the content of the component (c) is less than 0.5% by weight, that of the component (d) is less than 0.5% by weight and that of the component (e) is less than 0.5% by weight, the resulting grease composition does not exhibit the intended effect of the present invention, while if the content of the component (c) exceeds 10.0% by weight, the content of the component (d) exceeds 5.0% by weight and the content of the component (e) exceeds 5.0% by weight, any further improvement in the effect cannot be expected and the vibration-reduction effect is rather impaired.

The grease composition of the present invention may optionally comprise an antioxidant, a rust inhibitor and/or a corrosion inhibitor, in addition to the foregoing essential components.

The present invention will hereunder be described in more detail with reference to the following working Examples and Comparative Examples, but the present invention is not restricted to these specific Examples.

Examples 1 to 4, 6 to 10, 12 to 14 and Comparative Examples 1 to 7

A base oil (2500 g) was mixed with 12-hydroxystearic acid (500 g). The mixture was heated to 80° C. A 50% aqueous lithium hydroxide solution (140 g) was added to the mixture and stirred for 30 minutes. Then the mixture was heated to 210° C., after which it was cooled to 160° C. The base oil (1930 g) was added to the mixture and cooled below 100° C. during stirring to prepare a base lithium grease.

Additives listed in the following Table 1 or 2 were added to the base lithium grease in amounts defined in Table 1 or 2, mixed in a three-high roll mill to adjust the consistency of the mixture to No. 1 Grade to thus give grease compositions.

Examples 5 and 11

A base oil (500 g) was mixed with 12-hydroxystearic acid (90 g) and azelaic acid (30 g). The mixture was heated to 65° to 75° C. A 50% aqueous lithium hydroxide solution (55 g) was added to the mixture and stirred for 10 minutes. Then the mixture was heated to 95° to 120° C. and reacted for 30 minutes, after which it was heated to 210° C. and maintained at the temperature for 10 minutes and then cooled to 160° C. The base oil (352.5 g) was added to the mixture and stirred to prepare a base lithium complex grease.

Additives listed in the following Table 1 or 2 were added to the base lithium grease or the base lithium complex grease in amounts defined in Table 1 or 2, mixed in a three-high roll mill to adjust the consistency of the mixture to No. 1 Grade to thus give grease compositions.

The base oil used in the grease compositions of these Examples and Comparative Examples has the following composition:

| | |
|---|---|
| Kind of Base Oil: | mineral oil |
| Viscosity: | |
| at 40° C. | 60.8 $mm^2/s$ |
| at 100° C. | 7.7 $mm^2/s$ |
| Viscosity Index: | 88 |

Moreover, a commercially available lithium grease containing a sulfur-phosphorus atom containing extreme pressure agent was used as the grease of Comparative Example 8 and a commercially available calcium complex grease was used as the grease of Comparative Example 9.

Physical properties of these greases were evaluated according to the method detailed below. The results thus obtained are also listed in Tables 1 and 2.

[Penetration] This was determined according to the method defined in ISO 2137.

SRV Test]

| | |
|---|---|
| Test Piece: ball | diameter: 10 mm (SUJ-2) |
| cylindrical plate | diameter 24 mm × 7.85 mm (SUJ-2) |

Conditions for Evaluation:

Load 50N, 100N, 200N, 300N, 400N, 500N (After operating one minute at a load of 50N, then the load to be applied was increased 100N by 100N and the SRV tester was operated for one minute at each load.)

Frequency: 15 Hz

Amplitude: 1000 μm

Time: 6 minutes

Test Temperature: room temperature

Item to be Determined: Overall averaged value of friction coefficient for each load

[Axial Force-Determining Test]

In respect of vibrations of real joints, the slide resistance of a tripod type constant velocity joint in the axial direction during rotation was determined and this was defined to be the axial force. The rate of reduction in the axial force at each angle was determined on the basis of the results thus obtained while using the value observed for the commercially available calcium complex grease of Comparative Example 9 as a standard and the average of the values obtained at three angles was defined to be an averaged rate of reduction in the axial force.

Conditions for Determination

Number of Revolutions: 300 rpm torque: 637N.m

Angle of Joint: 6°,8°,10°

Measurement Time: After the operation of 10 minutes

TABLE 1

| | Example No. | | | | | | |
|---|---|---|---|---|---|---|---|
| Component | 1 | 2 | 3 | 4 | 5 | 6 | 7 |
| (1) | 96.0 | 96.0 | 95.0 | 95.0 | | 94.0 | 93.0 |
| (2) | | | | | 95.0 | | |
| (3) | 3.0 | | 2.0 | 3.0 | 3.0 | | 2.0 |
| (4) | | 3.0 | 2.0 | | | 3.0 | 2.0 |
| (5) | | | | 1.0 | 1.0 | | |
| (6) | 1.0 | 1.0 | 1.0 | 1.0 | 1.0 | 1.0 | 1.0 |
| (7) | | | | | | | |
| (8) | | | | | | | |
| (9) | | | | | | 2.0 | |
| (10) | | | | | | | |
| (11) | | | | | | | |
| (12) | | | | | | | 2.0 |
| Evaluation Test | | | | | | | |
| Penetration 60 W | 329 | 318 | 324 | 330 | 315 | 322 | 326 |
| SRV Test* | 0.039 | 0.041 | 0.038 | 0.037 | 0.038 | 0.037 | 0.036 |
| Axial Force** | −15 | −12 | −16 | −17 | −15 | −16 | −19 |

TABLE 1-continued

| Component | Example No. 8 | 9 | 10 | 11 | 12 | 13 | 14 |
|---|---|---|---|---|---|---|---|
| (1) | 93.0 | 93.0 | 93.0 | | 93.0 | 93.0 | 93.0 |
| (2) | | | | 93.0 | | | |
| (3) | 3.0 | 3.0 | 3.0 | 3.0 | 3.0 | 3.0 | 3.0 |
| (5) | 1.0 | 1.0 | 1.0 | 1.0 | 1.0 | 1.0 | 1.0 |
| (6) | 1.0 | | | 1.0 | 1.0 | 1.0 | 1.0 |
| (7) | | 1.0 | | | | | |
| (8) | | | 1.0 | | | | |
| (9) | 2.0 | 2.0 | 2.0 | 2.0 | | | |
| (10) | | | | | 2.0 | | |
| (11) | | | | | | 2.0 | |
| (12) | | | | | | | 2.0 |
| Evaluation Test | | | | | | | |
| Penetration 60 W | 331 | 328 | 329 | 318 | 326 | 325 | 329 |
| SRV Test* | 0.033 | 0.033 | 0.036 | 0.034 | 0.036 | 0.034 | 0.035 |
| Axial Force** | −33 | −31 | −22 | −30 | −23 | −22 | −24 |

TABLE 2

| Component | Comparative Example No. 1 | 2 | 3 | 4 | 5 | 6 | 7 |
|---|---|---|---|---|---|---|---|
| (1) | 100.0 | 97.0 | 97.0 | 99.0 | 98.0 | 95.0 | 94.0 |
| (2) | | | | | | | |
| (3) | | 3.0 | | | | 3.0 | |
| (4) | | | 3.0 | | | | 3.0 |
| (5) | | | | | | | |
| (6) | | | | 1.0 | | | 1.0 |
| (7) | | | | | | | |
| (8) | | | | | | | |
| (9) | | | | | 2.0 | 2.0 | 2.0 |
| (10) | | | | | | | |
| Evaluation Test | | | | | | | |
| Penetration 60 W | 325 | 326 | 321 | 323 | 328 | 324 | 329 |
| SRV Test* | 0.082 | 0.045 | 0.054 | 0.080 | 0.082 | 0.043 | 0.044 |
| Axial Force** | +3 | −5 | −4 | +3 | +4 | −7 | −6 |

| Component | Comparative Ex. No. 8 | 9 |
|---|---|---|
| commercially available lithium grease containing a sulfur-phosphorus atom containing extreme pressure agent | 100 | 0 |
| commercially available calcium complex grease | 0 | 100 |
| Evaluation Test | | |
| Penetration 60 W | 285 | 282 |
| SRV Test* | 0.080 | 0.082 |
| Axial Force** | +1 | Standard |

Note:
(1) base lithium grease
(2) base lithium complex grease.
(3) molybdenum dithlophosphate (Molyvan L, available from R.T. Vanderbilt Company).
(4) molybdenum dithiocarbamate (Molyvan A, available from R.T. Vanderbilt Company).
(5) molybdenum dithiocarbamate (Molyvan 822. available from R.T. Vanderbilt Company).
(6) zinc dithiophosphate I (Lubrizol 1360, available from Nippon Lubrizol Co., Ltd.).
(7) zinc dithiophosphate II (TLA 111, available from Texaco Company).
(8) zinc dithlophosphate III (TLA 252, available from Texaco Company).
(9) calcium salt of oxidized wax (Alox 165, available from Alox Corporation).
(10) calcium salt of petroleum sulfonate (Sulfol Ca-45, available from Matsumura Petroleum Laboratory Co., Ltd.).
(11) calcium salt of dinonylnaphthalenesulfonate (NA-SUL 729, available from KING INDUSTRIES Co., Ltd.).
(12) calcium overbasic alkylbenzenesulfonate (BRYTON C-400, available from WITCO CHEMICAL Company).
*SRV Test: averaged frictional coefficient
**Axial Force Measuring Test: Rate (%) of reduction in averaged axial force.

As has been explained above in detail, the grease composition for constant velocity joints according to the present invention comprises a grease, consisting of (a) a base oil and (b) a lithium-containing thickening agent selected from the group consisting of lithium soaps and lithium complex soaps, to which (c) an organic molybdenum compound, (d) a zinc dithiophosphate and optionally (e) a metal salt selected from the group consisting of metal salts of oxidized waxes, metal salts of petroleum sulfonates and metal salts of alkyl aromatic sulfonates are added, in a predetermined compounding ratio, and accordingly, exhibits a substantially improved effect of reducing friction coefficient and a substantially improved effect of preventing the occurrence of vibration as is clear from the test results of Examples and Comparative Examples listed in Tables 1 and 2.

What is claimed is:

1. A grease composition for constant velocity joints, which comprises:

(a) a base oil;

(b) a lithium-containing thickener selected from the group consisting of lithium soap and lithium complex soap;

(c) an organic molybdenum compound selected from the group consisting of molybdenum dithiophosphates and molybdenum dithiocarbamates, wherein the content of said organic molybdenum compound is 0.5 to 10.0% by weight based on the total weight of the grease composition;

(d) a zinc dithiophosphate, wherein the content of said zinc dithiophosphate is 0.5 to 5.0% by weight based on the total weight of the grease composition; and (e) a metal salt selected from the group consisting of metal salts of oxidized waxes, metal salts of petroleum sulfonates and metal salts of alkyl aromatic sulfonates, wherein said metal salt is a sodium, magnesium, calcium or barium salt, and the content of said metal salt if 0.5 to 5.0% by weight based on the total weight of the grease composition.

2. The grease composition for constant velocity joints of claim 1, wherein said organic molybdenum compound is a molybdenum dithiophosphate.

3. The grease composition for constant velocity joints of claim 1, wherein said organic molybdenum compound is a molybdenum dithiocarbamate.

4. The grease composition for constant velocity joints of claim 1, wherein said organic molybdenum compound is a mixture of a molybdenum dithiophosphate and a molybdenum dithiocarbamate.

5. The grease composition for constant velocity joints of claim 1, wherein said zinc dithiophosphate is represented by the formula:

$$(R^7O)(R^8O)SP—S—Zn—S—PS(OR^9)(OR^{10})$$

wherein $R^7$, $R^8$, $R^9$ and $R^{10}$ may be same or different and each represents an alkyl group having 1 to 24 carbon atoms or an aryl group having 6 to 30 carbon atoms.

6. The grease composition for constant velocity joints of claim 1, wherein said zinc dithiophosphate is represented by the formula:

$$(R^7O)(R^8O)SP—S—Zn—S—PS(OR^9)(OR^{10})$$

wherein $R^7$, $R^8$, $R^9$ and $R^{10}$ may be same or different and represent alkyl groups each having 1 to 24 carbon atoms.

7. The grease composition for constant velocity joints of claim 1, wherein said metal salt is a calcium salt.

8. The grease composition for constant velocity joints of claim 1, wherein said metal salt is a calcium salt of an oxidized wax.

* * * * *

UNITED STATES PATENT AND TRADEMARK OFFICE

CERTIFICATE OF CORRECTION

PATENT NO. : 5,516,439

DATED : May 14, 1996

INVENTOR(S) : Kiyoshi TAKEUCHI, et al.

It is certified that error appears in the above-indentified patent and that said Letters Patent is hereby corrected as shown below:

On the title page, Item [30], the Foreign Application Priority Data, is missing. It should read:

--July 15, 1994 [JP] Japan.....PCT/JP94/01165--

Signed and Sealed this

Thirteenth Day of August, 1996

Bruce Lehman

*Attest:*

BRUCE LEHMAN

*Attesting Officer*

*Commissioner of Patents and Trademarks*